US007784811B1

(12) United States Patent
Von DeBur

(10) Patent No.: US 7,784,811 B1
(45) Date of Patent: Aug. 31, 2010

(54) WHEELCHAIR BALL DEFLECTOR AND ASSOCIATED METHOD

(76) Inventor: Brian Gerard Von DeBur, 583 Pontiac La., Carol Stream, IL (US) 60188

( * ) Notice: Subject to any disclaimer, the term of this patent is extended or adjusted under 35 U.S.C. 154(b) by 673 days.

(21) Appl. No.: 11/704,577

(22) Filed: Feb. 9, 2007

(51) Int. Cl.
*A61G 5/10* (2006.01)

(52) U.S. Cl. ..... 280/304.1; 280/304.3

(58) Field of Classification Search ..... 280/304.1, 280/304.3
See application file for complete search history.

(56) References Cited

U.S. PATENT DOCUMENTS

| | | | | |
|---|---|---|---|---|
| 2,710,659 | A * | 6/1955 | Moederle | 180/11 |
| 3,999,778 | A | 12/1976 | Markiel | |
| 4,322,093 | A | 3/1982 | Otto | |
| 4,470,598 | A * | 9/1984 | Steele et al. | 473/56 |
| 4,500,102 | A | 2/1985 | Haury et al. | |
| 4,655,307 | A * | 4/1987 | Lamoureux | 180/69.1 |
| 5,322,312 | A * | 6/1994 | Cammack | 280/244 |
| 5,653,568 | A * | 8/1997 | Josephs | 414/557 |
| 5,921,258 | A | 7/1999 | Francois | |
| 5,997,017 | A | 12/1999 | Tilley | |
| 6,032,972 | A * | 3/2000 | Dias | 280/304.1 |
| 6,077,025 | A * | 6/2000 | Budd et al. | 414/546 |
| 6,095,271 | A * | 8/2000 | Dickie et al. | 180/68.5 |
| 6,361,058 | B1 | 3/2002 | Yuan | |
| 6,435,298 | B1 * | 8/2002 | Mizuno et al. | 180/346 |
| 6,655,708 | B2 | 12/2003 | Handango | |
| 7,121,572 | B1 * | 10/2006 | Jaffe et al. | 280/304.1 |
| 7,216,728 | B2 * | 5/2007 | Huang et al. | 180/13 |
| 7,243,938 | B2 * | 7/2007 | Stamps et al. | 280/304.1 |
| 2008/0041282 | A1 * | 2/2008 | Goschy et al. | 108/141 |

* cited by examiner

*Primary Examiner*—Lesley Morris
*Assistant Examiner*—Maurice Williams
(74) *Attorney, Agent, or Firm*—Montgomery Patent and Design; Robert C. Montgomery; Joseph T. Yaksich

(57) ABSTRACT

The present invention discloses a deflecting apparatus for wheelchairs to prevent objects from rolling underneath wheelchairs, especially when engaged in sport activities. The apparatus is an accessory item that attaches in the front of a wheelchair below the seat and just above the floor/ground level. It is configured as a guard specifically to prevent sport balls such as basketballs, soccer balls, volleyballs and the like from being trapped under the wheelchair. The apparatus is attached with a pair of clamping arms on the rear of the plate to connect the apparatus to the specific structure of the wheelchair, particularly on the kick plate and is adjustable to conform to various sizes of kick plates. Alternate embodiments could serve as deflectors for other objects that may become hazardous to the wheelchair free movement if allowed to travel underneath the chair from the front.

14 Claims, 6 Drawing Sheets

WHEELCHAIR BALL DEFLECTOR AND ASSOCIATED METHOD

RELATED APPLICATIONS

The present invention was first described in Disclosure Document No. 589,612 filed on Nov. 10, 2005.

FIELD OF THE INVENTION

This invention relates to ball deflectors and, more particularly, to a wheelchair accessory for deflecting portable objects away from a wheelchair such that the objects are prohibited from rolling underneath the wheelchair during sporting activities.

BACKGROUND OF THE INVENTION

Handicapped people confined to wheelchairs are faced with obstacles on a daily basis that most of us take for granted. Their wheelchairs are their main tool, which is used to help them become more integrated into society. These same wheelchairs become the main focus of their play and sport activities as well. Wheelchair bound participants can participate in activities such as basketball, volleyball and soccer. While the rules and regulations are somewhat changed to allow for more fun, their wheelchairs remain essentially unchanged. One problem with this scenario is the large balls sometimes roll under the chair or become trapped. This requires a time out to remedy the situation that reduces the fun for everyone. Accordingly, there exists a need for a means by which balls can be prevented from rolling under wheelchairs.

Several attempts have been made in the past to develop a wheelchair accessory for deflecting portable objects away from a wheelchair such that the objects are prohibited from rolling underneath the wheelchair during sporting activities. U.S. Pat. No. 6,655,708 in the name of Handago discloses a wheelchair that is provided with at least one safety bumper which is mounted to the frame of the wheelchair outwardly of one of the wheels. The outer surface of the bumper functions as a cam surface for contacting a door and maintaining the door open while the wheelchair passes through a doorway. The bumper could be adjustable in length and could be detachably mounted to the wheelchair. Unfortunately, this prior art example is designed as protection against undesirable contact with walls and door frames, and is not intended for deflecting portable objects away from the wheelchair during sporting activities.

U.S. Pat. No. 3,999,778 in the name of Markiel discloses a walker for use with a wheel chair. The walker has a generally "U"-shaped frame with a column swingably attached to the intermediate part of the "U"-shaped frame. A caster wheel is attached to the distal end of the column and a tube is swingably attached to the distal ends of the "U"-shaped frame. A pair of brackets is provided by attaching the front side of the wheel chair to the brackets. Each of the brackets has a telescoping pin. Clamps are provided on the tubular brackets which can be attached to the wheel chair and which receive the telescoping pins attached to the "U"-shaped frame. Unfortunately, this prior art example is designed to assist a user during walking, and is not appropriate as a deflection apparatus.

U.S. Pat. No. 5,921,258 in the name of Francois describes a detachable and collapsible weather shield for a wheelchair that may be user-disposed in a user-selected orientation. The weather shield includes first and second generally inverted "U"-shaped frames, in which the distal leg ends of the second frame are pivotally joined by a coupler to a leg portion of the legs of the first frame. A flexible moisture resistant canopy extends over at least the top portion of the frames and preferably also extends downward to also cover a portion of the legs. A releasable pivotable anchor is secured to one and preferably both wheelchair push arm regions, and permits releasably and rotatably attaching the distal leg ends of the first frame to the wheelchair. The anchor permits user-adjustment of the relative angular orientation of the first frame (and thus of the weather shield) and/or the vertical height (including complete removal) of the weather shield relative to the ground. The anchor unit may be manually operable, or may be motorized. If motorized, user-generated control signals may be wirelessly transmitted to a receiver associated with the motor, or hardwiring may be provided. Unfortunately, this prior art example is designed as a weather shield to be used during inclement weather conditions, and provides no protection against portable objects that may roll underneath a wheelchair. In addition, such an invention makes a wheelchair unsuitable for use during sporting activities.

U.S. Pat. No. 4,500,102 in the name of Haury, et al discloses a sports wheelchair that includes a one-piece, welded tubular frame assembly. A pair of rear wheels is horizontally and adjustably positionable in a rear wheel mounting plate. The mounting plate has a plurality of slots and a plurality of alternating ridges and valleys which mesh with like ridges and valleys on an axle receiving assembly. A pair of front wheels is mounted with a front wheel mounting assembly to be selectively positioned in any one of three vertical positions. The front wheels are further mountable on the inside or the outside of a lower horizontal frame portion and in any one of a plurality of positions fore and aft along the horizontal frame portion. The user is supported by a fabric seat which is laced to upper horizontal frame portions and to a back structure. The back structure is connected with the frame structure by a hinge such that the back is selectively foldable for easier transportation. A foot supporting structure is selectively positionable in any one of a plurality of positions. A roller is positioned on the foot support to inhibit the chair from tipping forward. A shield inhibits the fingers of the user or others from engaging spokes of the rear wheel and causing injury. Unfortunately, this prior art example does not provide an assembly for attaching to the existing wheelchair for deflecting objects away from the wheelchair, or preventing objects from rolling underneath the wheelchair, while being used for its intended purpose as a wheelchair for sporting activities.

None of the prior art particularly describes a wheelchair accessory for deflecting portable objects away from a wheelchair such that the objects are prohibited from rolling underneath the wheelchair during sporting activities. Accordingly, there is a need for an assembly which provides such features while overcoming the above-noted shortcomings.

SUMMARY OF THE INVENTION

In view of the foregoing disadvantages inherent in the prior art, it has been observed that there is need for a wheelchair accessory for deflecting portable objects away from a wheelchair such that the objects are prohibited from rolling underneath the wheelchair during sporting activities.

A wheelchair accessory for deflecting portable objects away from a wheelchair includes a front guard including a protective plate provided with planar front and rear surfaces clearing a ground surface and fully covering a single foot platform of the wheelchair. Such a front guard has a curved front face, which is essential for assisting a user to better handle the object during sporting procedures, and further has opposed rectilinear sides equidistantly spaced from a central longitudinal axis thereof. Such a curved front face of the front guard allows a portable object to be advantageously deflected towards user hands, as opposed to being undesirably deflected away from the wheelchair and the user during sporting activities.

The accessory further includes a plurality of support arms, provided with a hole drilled therethrough respectively, wherein a first pair of the support arms are defined as upper support arms and are directly coupled to the plate, without the use of intervening elements. A second pair of the support arms is defined as lower support arms and are directly coupled to the plate, without the use of intervening elements, and equidistantly spaced apart from the upper support arms. Such upper and lower support arms are coextensively shaped and extend vertically away from the plate, which is critical such that the upper and lower support arms are registered orthogonal to the plate. The support arms are telescopically adaptable between elongated and retracted positions, which are crucial for allowing a user to adjust the support arms as necessary based upon a user size and need, and thereby maximize the effectiveness of the accessory.

The accessory further includes a mechanism for independently connecting each of the support arms to the plate. Such a support arm connecting mechanism includes a pair of eyebolts inserted through axially aligned holes formed within the upper and lower support arms respectively for removably attaching the front guard to the single foot platform of the wheelchair. Such removability of the support arm connecting mechanism allows a user to easily remove the front guard from the wheelchair during conditions when the accessory is not needed, thus returning the wheelchair to a standard configuration. The independent support arm connecting mechanism further includes a plurality of static "L"-shaped brackets directly attached to exterior lateral faces of the lower support arms and the rear surface of the plate respectively, without the use of intervening elements, which is vital such that the lower support arms are advantageously prohibited from pivoting.

A plurality of dynamic "L"-shaped brackets is also directly attached to exterior lateral faces of the upper support arms and the rear surface of the plate respectively, without the use of intervening elements, which is important such that the upper support arms are pivotal along corresponding arcuate paths. Such dynamic "L"-shaped brackets permit radial downward movement of the upper support arms about a horizontal axis, and such downward movement is defined along a 90 degree path terminating at a predetermined final angle located adjacent to a rear side of the front guard. Such positioning of the upper support arms adjacent to a rear side of the front guard is necessary for advantageously preventing the upper support arms from impeding a user performance during sporting activities.

The accessory further includes a mechanism for attaching the support arms to the wheelchair, which is essential such that the single foot platform is medially registered between the support arms respectively and thereby advantageously prohibits the object from rolling underneath the wheelchair. Such an independent support arm attaching mechanism includes a plurality of tracks formed along the plate, wherein each of such tracks is provided with a plurality of track guides extending therealong. The support arms are adjustably positional along the track guides, which is critical such that each of the support arms is independently adaptable along the tracks.

The independent adaptability of the support arms provides the unexpected benefit of allowing a user to attach the accessory to many different types and sizes of wheelchairs, and then selectively position the support arms as desired to maximize the performance of a user during sporting activities. This independent adaptability combined with the advantageous deflective capabilities of the curved front face of the front guard overcomes the above-noted shortcomings of the prior art.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
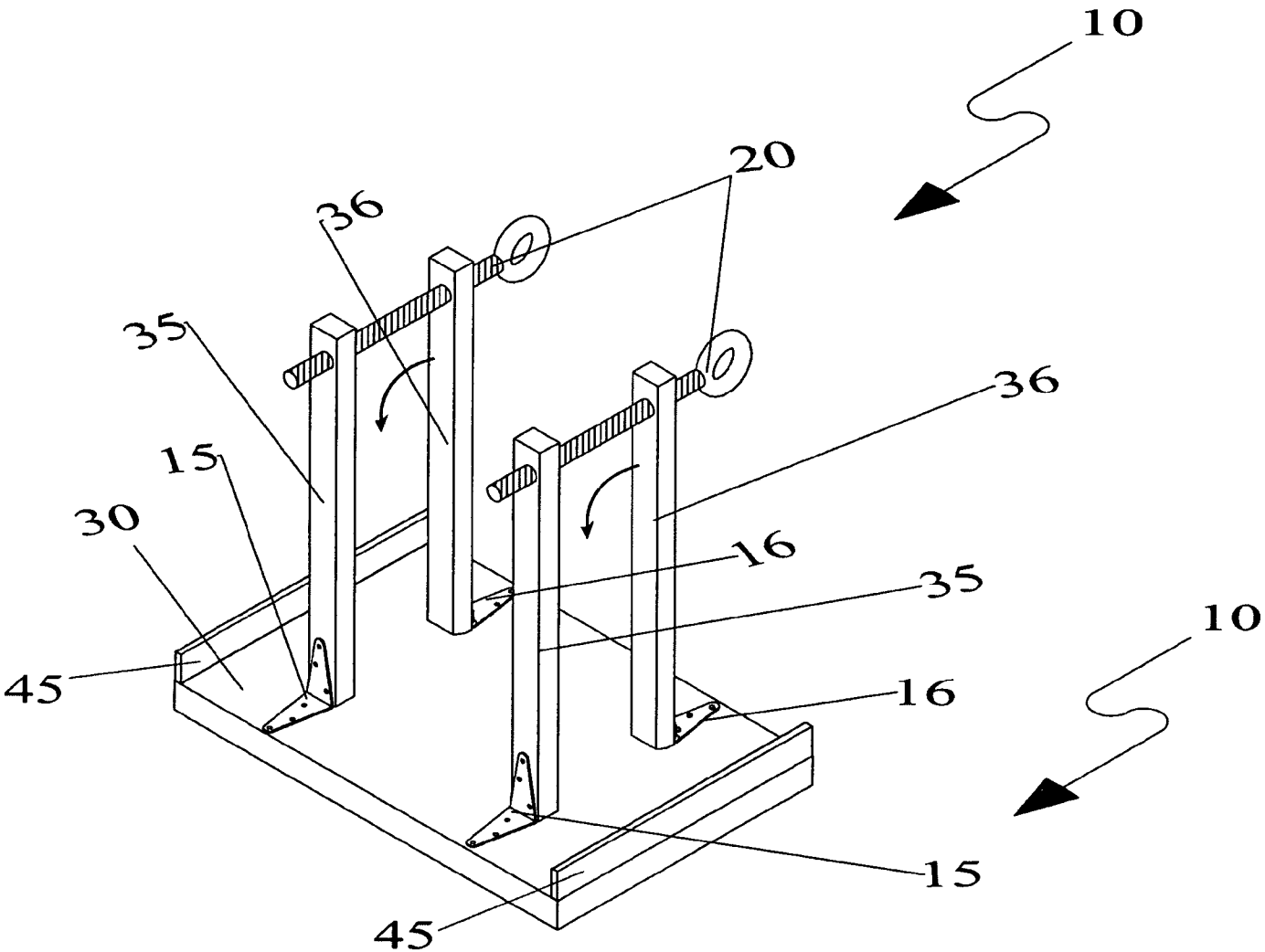
FIG. 1 is a perspective view of a wheelchair ball deflector 10, according to the preferred embodiment of the present invention.

10 wheelchair ball deflector
11 drilled hole
15 stationary bracket
16 hinged bracket
20 eyebolt
23 hole
26 pin
27 lower telescopic shaft
28 upper telescopic shaft
30 front guard
35 lower support arm
36 upper support arm
37 lower telescopic support arm
38 upper telescopic support arm
40 track system
41 slot
42 bolt
43 nut
45 lip
50 single foot platform

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method that aids in the deflection of objects for wheelchairs preventing said objects from rolling, progressing, or meandering underneath wheelchairs, especially during engagement of sport activities. The wheelchair ball deflector (herein described as the "apparatus") 10 comprises a front guard 30, a pair of two (2) support arms 35, 36 with a hole 11 drilled therethrough, and means to connect said pair of arms 35, 36 to a wheelchair. The apparatus 10 is envisioned to be fabricated of lightweight materials such as, but not limited to, plastics, aluminum, lightweight steel, wood, and/or other materials suitable for the application.

Referring now to FIG. 1, a perspective view of the apparatus 10 according to the preferred embodiment of the present invention, is disclosed. A front guard 30, having four (4) linear planes in a form of a rectangular-shaped plate with level surfaces on each plane, is utilized as the deflecting device. The front guard 30 has a longitudinal span comprising a dimension enabling it to clear the ground and a lateral span comprising a dimension enabling it to fully cover and minimally extend past the width of the single foot platform 50. Preferably, the front guard 30 is envisioned to comprise a nine (9) inch longitudinal span with a fourteen (14) inch lateral span with varying thickness. A pair of lips 45 extends perpendicularly outward from each lateral edge of the front guard 30 to create a greater surface and to enhance the deflecting capabilities of the device 10.

The apparatus 10 may be introduced as being "sporty" looking with a variety of aesthetically pleasing colors and combination thereof with or without motifs and/or other images such as, but not limited to, cartoon characters, sport logos, flames, animals, country flag, state flag and/or other motif designs adhered or attached thereon the front face of the front guard 30. Alternatively, the front guard 30 may be introduced unembellished providing the option of motifs to be added on later, if desired. The front guard 30 may also include inscribing such as, but not limited to, user's name, special dates, quotes, and/or other terms and expressions instead of or in combination with the colors and/or motifs.

Figure 2:
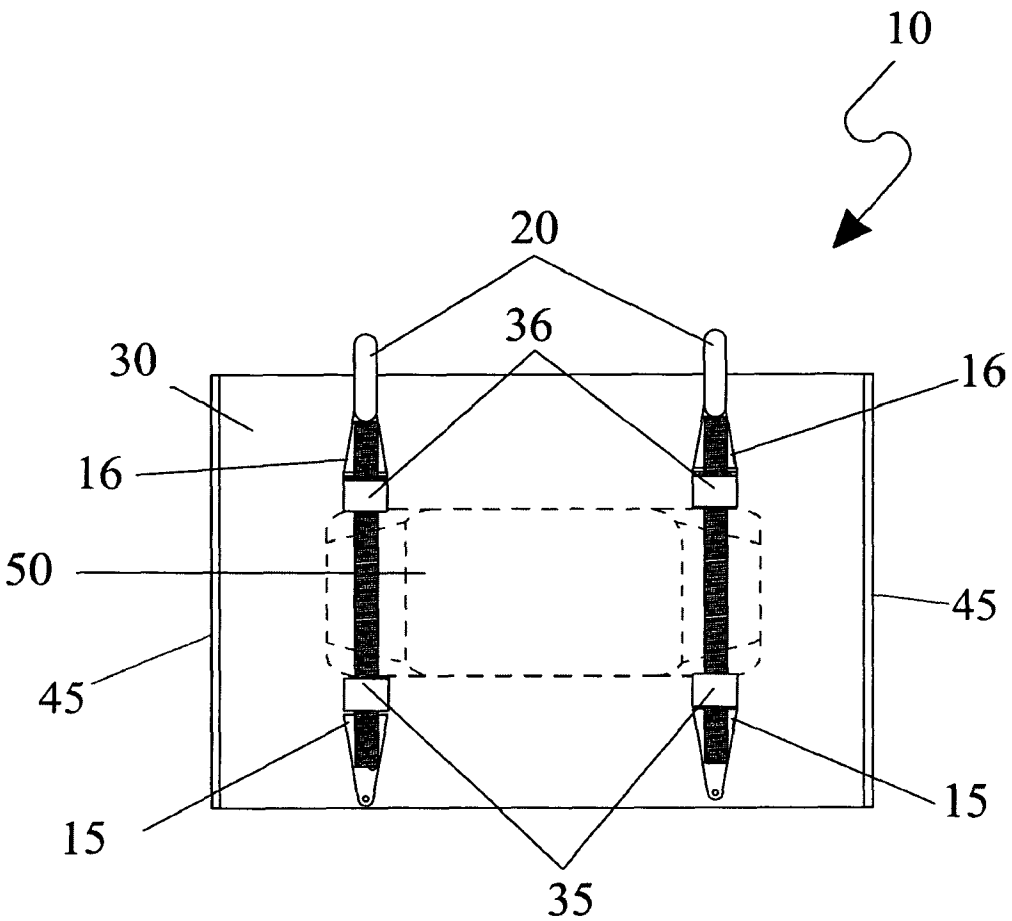
FIG. 2 is a rear view of the wheelchair ball deflector, according to the preferred embodiment of the present invention.
Figure 3:
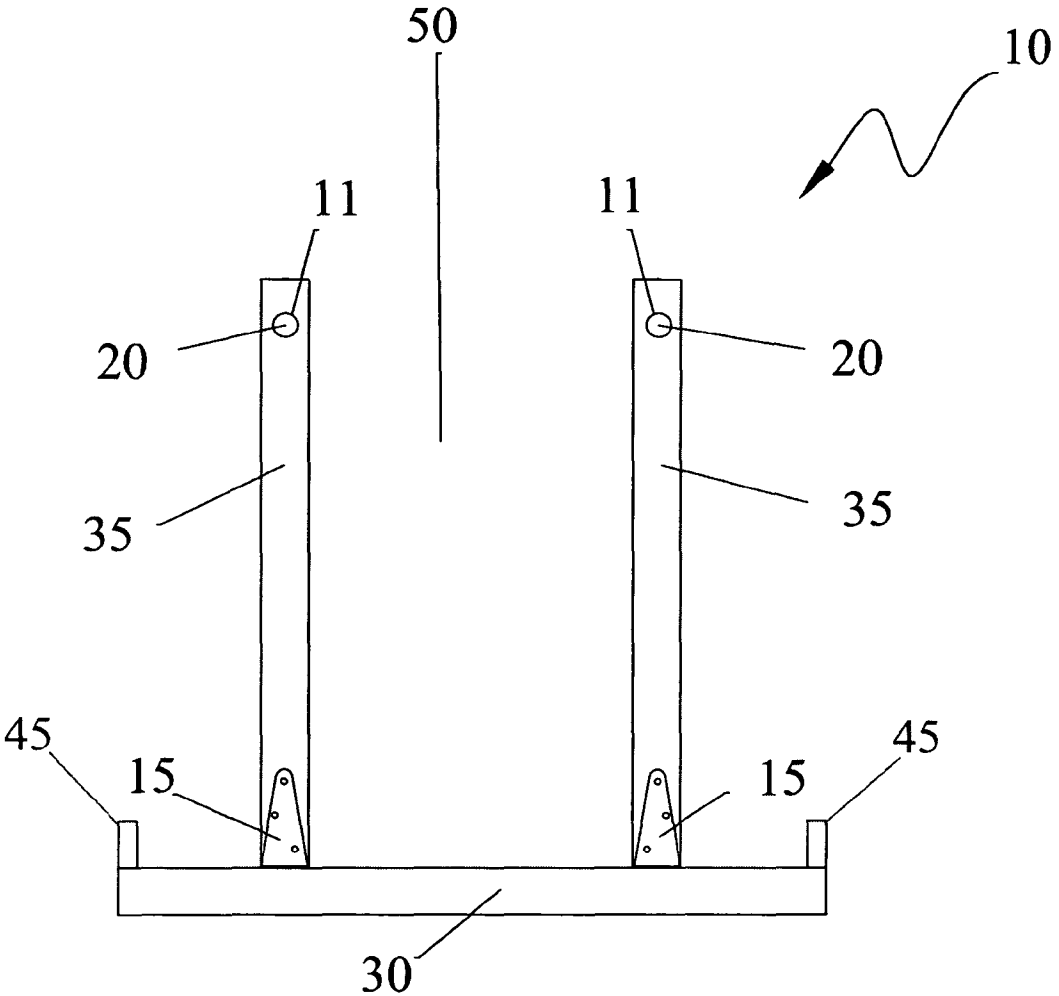
FIG. 3 is a bottom view of the wheelchair ball deflector, according to the preferred embodiment of the present invention; and, FIG. 4 is a side elevation view of the wheelchair ball deflector 10, according to the preferred embodiment of the present invention; and, FIG. 5 is a side elevation view of the wheelchair ball deflector 10, according to an alternate embodiment of the present invention; and, FIG. 6 is a perspective view of the wheelchair ball deflector 10, according to an alternate embodiment of the present invention.
Figure 4:
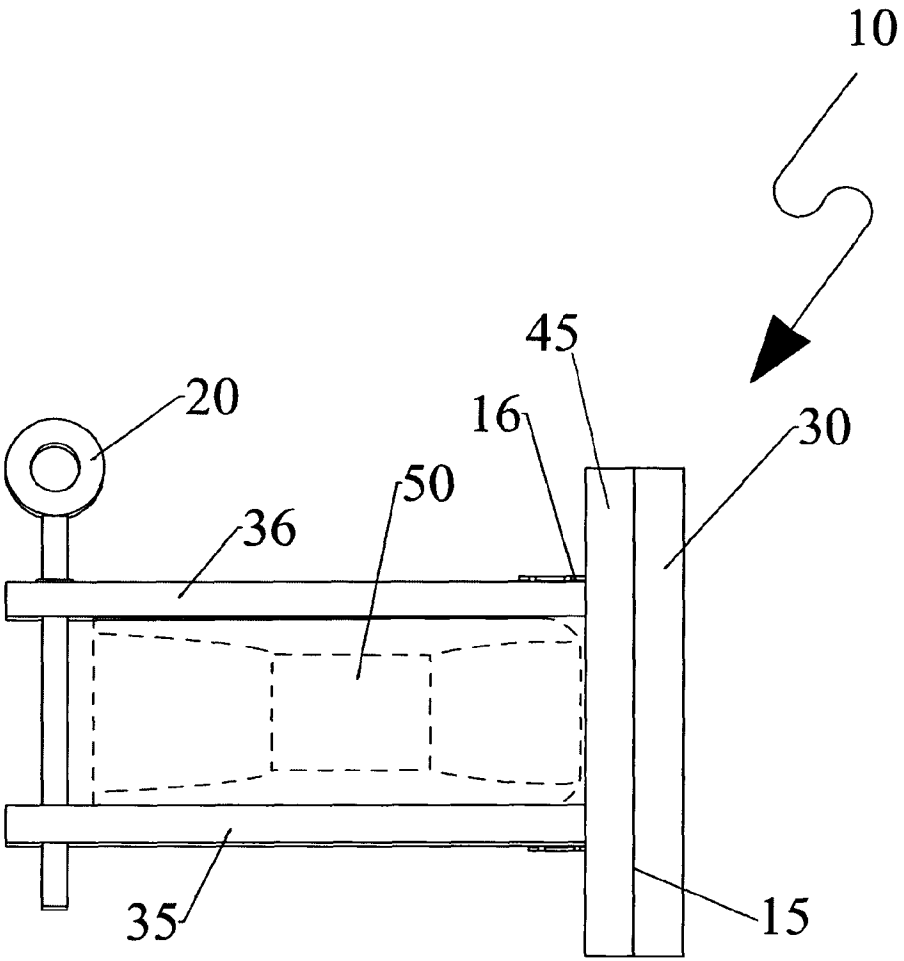

Referring now to FIGS. 2-4, views of the apparatus 10 illustrated with a single foot platform 50 of a wheelchair inserted therebetween two (2) upper support arms 36 and two (2) lower support arms 35 according to the preferred embodiment of the present invention, is disclosed. A pair of two (2) support arms 35, 36 is symmetrically mounted thereto said front guard 30 utilizing brackets 15, 16. The two (2) support arms 35 on the lower portion thereof is statically mounted thereto the rear surface of the front guard 30 utilizing stationary brackets 15 while the two (2) support arms 36 on the upper portion thereof is dynamically mounted thereto the rear surface of the front guard 30 utilizing hinged brackets 16.

The brackets 15, 16 comprise a plurality of holes drilled therethrough for insertion of a fastener. Each of the four (4) brackets 15, 16 is attached thereto the assigned support arm 35, 36 and the front guard 30 utilizing a plurality of screws, bolts, nails, or the like inserted therethrough the drilled holes thereof. The hinged brackets 16 permit radial downward movement of the two (2) upper support arms 36 about the horizontal axis providing radial movement from 90 degrees to a specified final angle in regards to the rear side of the front guard 30 thereof. The two (2) lower support arms 35 are statically stationed tangentially thereto the back side of the front guard 30.

A pair of eyebolts 20 are inserted therethrough axially aligned drilled holes 11 of the support arms 35, 36. Tightening said eyebolts 20 further constricts the single foot platform 50 thereby removably securing the apparatus 10 on the desired electric or manual wheelchair, scooter, or the like.

Figure 5:
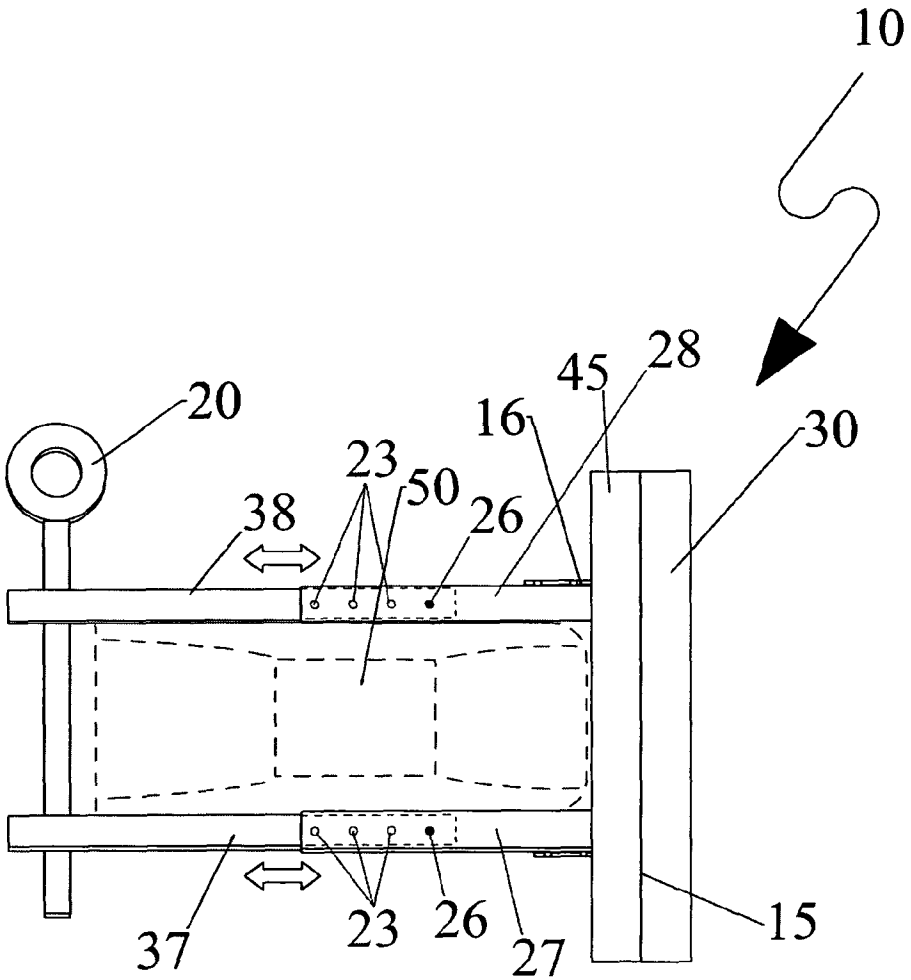

Referring now to FIG. 5, an alternate embodiment of the present invention 10 is herein disclosed. In this embodiment, the upper 38 and lower support arms 37 are telescopic within respective upper 28 and lower telescopic shafts 27, thereby enabling the user to incrementally adjust the length according to the dimensions of the wheelchair platform 50 as needed. A pair of spring-loaded pins 26, each located at a proximal end of the upper 38 and lower telescopic support arm 37, are designed to be received within a series of equidistantly-spaced holes 23 formed within a proximal end of the upper 28 and lower telescopic shafts 27 to secure the telescopic support arms 37, 38 at a desired position.

Figure 6:
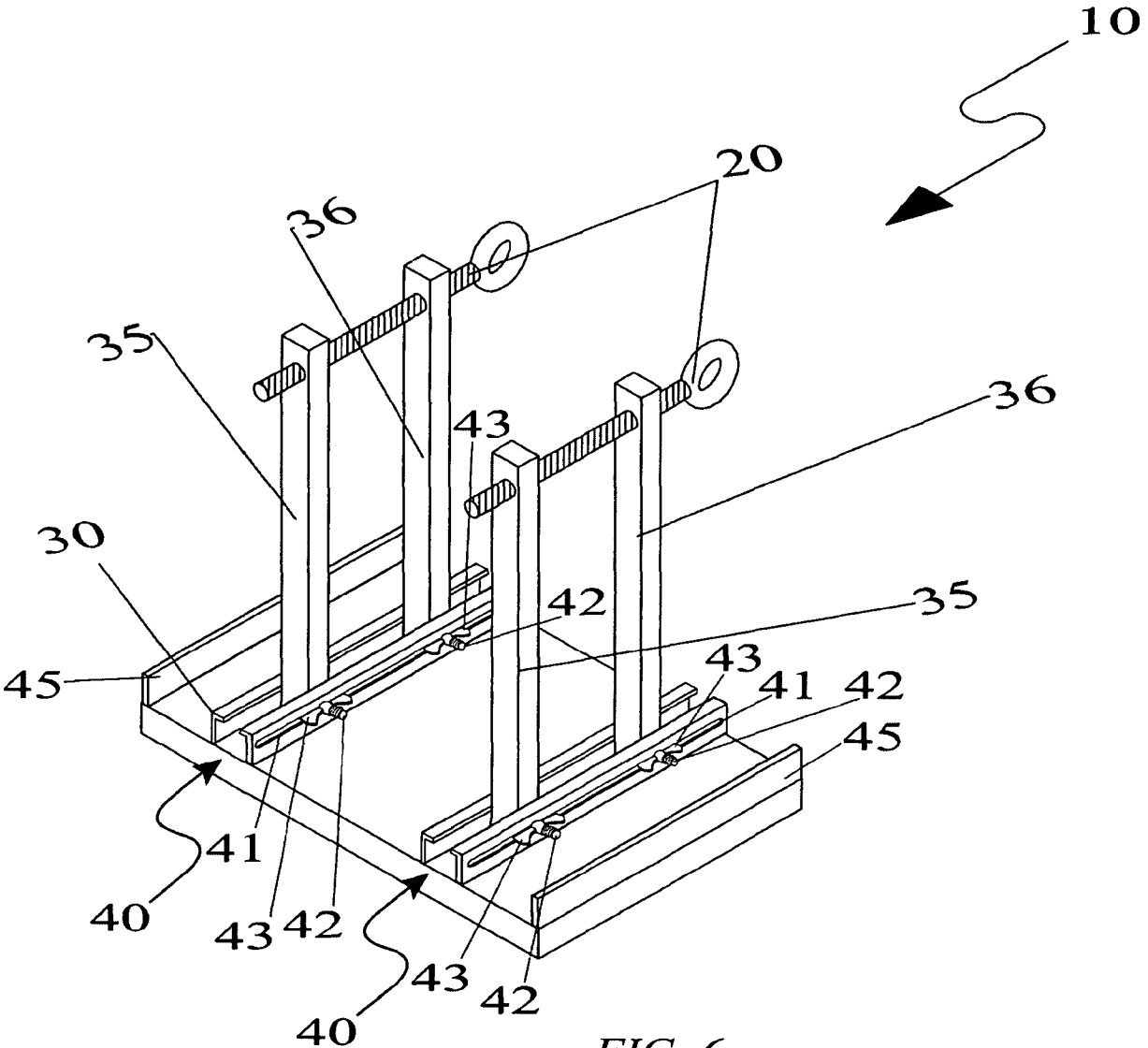

Referring finally to FIG. 6, an alternate embodiment of the present invention 10 is herein disclosed. This embodiment illustrates an alternate method of adjusting the upper 36 and lower support arms 35 by means of a pair of track systems 40, thereby enabling each support arm 35, 36, to be incrementally adjustable along the length of the front guard 30. Each track system 40 comprises an upstanding "U"-shaped frame with a pair of slots 41 formed along an interior length of each upstanding wall. The proximal ends of each support arms 35, 36 have a bolt 42 protruding through each end such that it is carried through the slots 41 of the track system 40 and secured thereto with a nut 43 when a desired position is achieved.

An alternate embodiment of the present invention 10 may comprise a front guard 30 in a plurality of configurations such as a curved front face for better ball handling for sports like soccer, for example.

Another alternate embodiment of the present invention 10 could serve as deflectors for other objects that may become hazardous to unhindered wheelchair movement if allowed to travel underneath said wheelchair.

Yet another alternate embodiment of the present invention 10 may comprise other attachment means such as a series of arms on the back side of the front guard 30 connected to the wheelchair frame utilizing conventional connecting and disconnecting means. Also, the front guard 30 may be mounted thereon the support arms 35, 36 utilizing other alternate means such as welding, tacking, riveting, or the like. In addition, the apparatus 10 could comprise attachment means to removably affix the apparatus 10 to a wheelchair comprising two (2) foot platforms and/or single foot platform 50.

The preferred embodiment of the present invention can be utilized by the common wheelchair bound user in a simple and effortless manner with minimal training.

The apparatus 10 is envisioned to be fabricated of a lightweight metallic and/or plastic material comprising hinged 15 and stationary brackets 16 to attach the front guard 30 therewith the support arms 35, 36. The support arms 35, 36 are removably attachable thereto the desired wheelchair, scooter, or the like utilizing the radial motions to adjustably attach thereto the single foot platform 50 and securing utilizing eyebolts 20. The wheelchair bound users can find this apparatus 10 to greatly assist them in participating in a plurality of sport activities without the trepidation of soccer balls, volleyballs, basketballs, or any other ball or object from traveling under the wheelchair.

The method of utilizing the device may be achieved by performing the following steps: attaching brackets, hinged 16 and stationary 15, thereto the rear of the front guard 30 utilizing set screws, bolts, nails, or the like, if not already attached wherein the stationary brackets 15 are attached to the bottom half of the front guard 30 and the hinged brackets 16 are attached to the top half of the front guard 30, each bracket attached at a distance roughly matching the dimensions of the single foot platform 50; attaching brackets, hinged 16 and stationary 15, thereto the support arms, upper 36 and lower 35 respectively—each support arm 35, 36 having the same dimensions as each other—utilizing set screws, bolts, nails, or the like, if not already attached; inserting single foot platform 50 therebetween the upper support arms 36 and the lower support arms 35; utilizing the eyebolts 20 to progress the upper support arms 36 toward the lower support arms 35 thereby compressing the single foot platform 50 and providing a snug fit; removing the apparatus 10 therefrom the wheelchair after use; and, storing accordingly.

The apparatus 10 is envisioned to be introduced as an accessory item attaching thereto the front of a wheelchair below the seat and just above the ground level. The use of the apparatus 10 deflects the ball to bounce or deflect outward, if coming in contact with the apparatus 10, providing a means to permit wheelchair bound people the ability to enjoy multiple sports without worry of the balls becoming trapped under the wheelchair. The fissure is envisioned to accommodate adequate space therebetween the front guard 30 and the ground such to prevent entities from building up in front of apparatus 10 while the wheelchair is in motion thereby preventing objects such as basketballs, volleyballs, soccer balls, and/or other objects of a plurality of shapes and sizes from rolling, progressing, or meandering underneath wheelchairs, especially during engagement of sport activities.

The apparatus 10 is envisioned to be removably attachable to a manual or electrically motorized wheelchair, scooter, or the like comprising a single foot platform 50. The single foot platform 50, attached to the wheelchair frame, is positioned therebetween the upper support arms 36 and lower support arms 35. The hinged bracket 16 connecting the two (2) upper support arms 36 to the front guard 30 permits radial downward motion of said upper support arms 36 about the connection point toward the stationary lower support arms 35. The support arms 35, 36 compress and constrict the single foot platform 50 by utilizing said radial features of the upper support arms 36 and affixed into place utilizing eyebolts 20.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A wheelchair accessory for deflecting portable objects away from a wheelchair such that said objects are prohibited from rolling underneath said wheelchair during sporting activities, said wheelchair accessory comprising:

a front guard including:

a protective plate provided with planar front and rear surfaces clearing a ground surface and fully covering a single foot platform of said wheelchair;

a plurality of support arms provided with a hole drilled therethrough respectively, further comprising:

a first pair of support arms defined as upper support arms directly coupled to said plate; and, a second pair of support arms defined as lower support arms directly coupled to said plate and equidistantly spaced apart from said upper support arms, said upper and lower support arms being coextensively shaped and extending vertically away from said plate such that said upper and lower support arms are registered orthogonal to said plate;

means for independently connecting each of said support arms to said plate, further comprising:

a plurality of static "L"-shaped brackets directly attached to exterior lateral faces of said lower support arms and said rear surface of said plate respectively such that said lower support arms are prohibited from pivoting; and, a plurality of dynamic "L"-shaped brackets directly attached to exterior lateral faces of said upper support arms and said rear surface of said plate respectively such that said upper support arms are pivotal along corresponding arcuate paths; and, means for attaching said support arms to the wheelchair such that said single foot platform is medially registered between said support arms respectively and thereby prohibiting an object from rolling underneath said wheelchair.

2. The wheelchair accessory of claim 1, wherein said dynamic "L"-shaped brackets permit radial downward movement of said upper support arms about a horizontal axis, said radial downward movement being defined along a 90 degree path terminating at a predetermined final angle located adjacent to a rear side of said front guard.

3. The wheelchair accessory of claim 1, wherein said front guard has a curved front face for assisting a user to better handle the object during sporting procedures.

4. The wheelchair accessory of claim 1, wherein said front guard has opposed rectilinear sides equidistantly spaced from a central longitudinal axis thereof.

5. The wheelchair accessory of claim 1, wherein said support arms are telescopically adaptable between elongated and retracted positions.

6. The wheelchair accessory of claim 1, wherein said independent support arm attaching means comprises:

a plurality of tracks formed along said plate, each of said tracks being provided with a plurality of track guides extending therealong, said support arms being adjustably positional along said track guides such that each of said support arms are independently adaptable along said tracks.

7. A wheelchair accessory for deflecting portable objects away from a wheelchair such that said objects are prohibited from rolling underneath said wheelchair during sporting activities, said wheelchair accessory comprising:

a front guard including:

a protective plate provided with planar front and rear surfaces clearing a ground surface and fully covering a single foot platform of said wheelchair;

a plurality of support arms provided with a hole drilled therethrough respectively, further comprising:

a first pair of said supports arms is defined as upper support arms directly coupled to said plate; and, a second pair of said support arms are defined as lower support arms directly coupled to said plate and equidistantly spaced apart from said upper support arms, said upper and lower supports arms being coextensively shaped and extending vertically away from said plate such that said upper and lower support arms are registered orthogonal to said plate;

means for independently connecting each of said support arms to said plate, further comprising:

a plurality of static "L"-shaped brackets directly attached to exterior lateral faces of said lower support arms and said rear surface of said plate respectively such that said lower support arms are prohibited from pivoting;

a plurality of dynamic "L"-shaped brackets directly attached to exterior lateral faces of said upper support arms and said rear surface of said plate respectively such that said upper support arms are pivotal along corresponding arcuate paths a pair of eyebolts inserted through axially aligned holes formed within said upper and lower support arms respectively for removably attaching said front guard to said single foot platform of said wheelchair; and, means for attaching said support arms to said wheelchair such that said single foot platform is medially registered between said support arms respectively and thereby prohibiting an object from rolling underneath said wheelchair.

8. The wheelchair accessory of claim 7, wherein said dynamic "L"-shaped brackets permit radial downward movement of said upper support arms about a horizontal axis, said radial downward movement being defined along a 90 degree path terminating at a predetermined final angle located adjacent to a rear side of said front guard.

9. The wheelchair accessory of claim 7, wherein said front guard has a curved front face for assisting a user to better handle the object during sporting procedures.

10. The wheelchair accessory of claim 7, wherein said front guard has opposed rectilinear sides equidistantly spaced from a central longitudinal axis thereof.

11. The wheelchair accessory of claim 7, wherein said support arms are telescopically adaptable between elongated and retracted positions.

12. The wheelchair accessory of claim 7, wherein said independent support arm connecting means comprises:

a plurality of tracks formed along said plate, each of said tracks being provided with a plurality of track guides extending therealong, said support arms being adjustably positional along said track guides such that each of said support arms are independently adaptable along said tracks.

13. A method of prohibiting a mobile object from penetrating beneath a single foot platform of a wheelchair during a sporting activity, said method comprising the steps of:

a. attaching a plurality of dynamic "L"-shaped hinged brackets to a rear surface of a front guard;

b. attaching a plurality of static "L"-shaped stationary brackets to said rear surface of said front guard, wherein said stationary brackets are attached to a bottom half of the front guard and said hinged brackets are attached to a top half of the front guard;

c. attaching said hinged and stationary brackets to a plurality of coextensively shaped upper and lower support arms respectively;

d. inserting a single foot platform between said upper support arms and said lower support arms respectively, each of said hinged and stationary brackets being attached along a perimeter of said single foot platform such that said single foot platform is medially seated between said hinged and stationary brackets respectively; and, e. utilizing a plurality of eyebolts to progress said upper support arms toward said lower support arms and thereby snugly compressing said single foot platform against said front guard.

14. The method of claim 13, further comprising the step of:

a. removing said front guard and said upper and lower support arms from said wheelchair after said sporting activity has ended.

* * * * *